US005245395A

United States Patent [19]

Pawlik et al.

[11] Patent Number: 5,245,395

[45] Date of Patent: Sep. 14, 1993

[54] RECORDING SUBSTRATE WAVE RESTRICTOR

[75] Inventors: Robert S. Pawlik, Webster; Robert E. Gary, Ontario, both of N.Y.

[73] Assignee: Xerox Corporation, Stamford, Conn.

[21] Appl. No.: 756,247

[22] Filed: Sep. 6, 1991

[51] Int. Cl.[5] ..... G03G 21/00

[52] U.S. Cl. ..... 355/315; 271/307; 355/282; 355/308

[58] Field of Search ..... 355/282, 290, 289, 295, 355/274, 277, 271, 276, 309, 315, 308; 271/161, 188, 307, 311, 312, 313

[56] References Cited

U.S. PATENT DOCUMENTS

| | | | |
|---|---|---|---|
| 4,028,050 | 6/1977 | Bar-on | 432/59 |
| 4,755,848 | 7/1988 | Tamary | 355/289 X |
| 4,771,310 | 9/1988 | Leo et al. | 355/3 SH |
| 4,860,047 | 8/1989 | Pirwitz | 355/290 |
| 4,929,983 | 5/1990 | Barton et al. | 355/315 |
| 4,937,631 | 6/1990 | Kim et al. | 355/290 |
| 4,939,550 | 7/1990 | Takada et al. | 355/282 |
| 4,942,420 | 7/1990 | Tomizawa et al. | 355/27 |
| 4,943,863 | 7/1990 | Ainoya | 355/271 |
| 4,994,861 | 2/1991 | Brandon et al. | 355/274 |

*Primary Examiner*—A. T. Grimley
*Assistant Examiner*—T. A. Dang
*Attorney, Agent, or Firm*—Denis A. Robitaille

[57] ABSTRACT

An improved fusing apparatus including a baffle assembly having at least one member for imparting an arcuate-shaped profile in a sheet of recording substrate subsequent to the transport thereof through a fuser nip. The arcuate-shaped profile is imparted along a generally central axis of the recording substrate, substantially perpendicular to the path of movement thereof, providing lateral strength to the substrate for eliminating the formation of longitudinal waves therein.

17 Claims, 4 Drawing Sheets

RECORDING SUBSTRATE WAVE RESTRICTOR

The present invention relates generally to an electrostatographic printing machine, and more particularly concerns a fuser apparatus including a baffle assembly for preventing the formation of waves in a sheet of recording substrate transported through the fuser assembly.

Generally, the process of electrostatographic copying is executed by exposing an optical image of an original document to a substantially uniformly charged photoreceptive member. Exposing an optical image to the charged photoreceptive member discharges the photoconductive surface thereof in areas corresponding to non-image segments in the original document, while maintaining charge on the photoreceptive member in image segments, thereby creating an electrostatic latent image of the original document on the photoreceptive member. This electrostatic latent image is subsequently developed into a visible image by a process in which a charged developing material is deposited onto the photoconductive surface of the photoreceptor such that the developing material is attracted to the charged image areas thereon. The developing material is then transferred from the photoreceptive member to a copy sheet on which the image may be permanently affixed to provide a reproduction of the original document. The final step in this process involves cleaning the photoconductive surface of the photoreceptive member to remove any residual developing materials therefrom in preparation for successive imaging cycles.

The process used to produce multi-color electrophotographic copies is substantially similar to the process described above for black and white copies. However, multi-color electrophotographic printing further incorporates the creation of multiple latent images corresponding to different primary colors which are each recorded on the photoreceptive member and each developed with a developing material of a primary complimentary color. One known process for producing multi-color electrophotographic copies involves the superimposed transfer of each single color toner image to a sheet of recording substrate in perfect registration with one another to produce a multi-layered, multi-color toner image on the recording substrate. Thereafter, the multi-layered toner image is permanently affixed to the recording substrate to generate a multi-color copy of the original document. Finally, the recording substrate, having the fused toner image thereon, is transported to an output tray to provide a finished output document.

The process of permanently affixing a toner image to a sheet of recording substrate is known as fusing. The fusing process permanently bonds, or fixes, the toner image to the recording substrate. Several methods are known in the art for accomplishing this goal, including: hot roll fusing; cold roll fusing; radiant fusing; and solvent fusing. Amongst hot roll fusing methods, it is well known to use various combinations of a heated fuser roll and a backup pressure roll configured to provide a fuser nip through which the recording substrate is passed. In order to permanently affix or fuse electroscopic toner material onto a sheet of recording substrate using heat, it is necessary to elevate the temperature of the toner material to a point at which the constituents of the toner material intermingle and become tacky. Thermal action also causes the toner material to be absorbed to some extent into the fibers or pores of the recording substrate. Thereafter, the toner material cools and solidifies to become bonded to the recording substrate. In a typical two-roll fusing apparatus, the fuser roll is coated with an adhesive material such as silicone rubber or other low surface energy elastomer, as for example, room temperature vocanizable silicones, high temperature vocanizable silicones, or liquid injection moldable silicone rubbers. The use of thermal energy for fixing toner images onto a recording substrate is old and well known in both the xerographic as well other electrostatographic recording arts.

Despite the use of low surface energy materials in the fuser roll surface of thermal fusing devices, there is a tendency for the recording substrate to remain adhered to or tacked to the fuser roll after traveling through the fuser nip formed by the fuser roll and the backup pressure roll. As a result, the recording substrate does not follow the normal path through the nip but rather continues in an arcuate path with the fuser roll. It is common practice, therefore, to use one or more techniques to ensure that the recording substrate is appropriately separated from the fuser roll in accordance with proper product specifications. A common approach for inducing separation of the recording substrate is the use of a stripper finger or a plurality of stripper fingers which contact the fuser roll or the backup pressure roll to form a wedge therebetween. The approach of using stripper fingers has the effect of implanting a relatively smooth sloping surface between the leading edge of the recording substrate and the fuser nip so that the substrate becomes separated from the roll as it travels through the nip. Such stripper finger systems have been used successfully to ensure that the recording substrate proceeds along a predetermined path subsequent to the fuser nip, onto a conveyor or the like in order to exit the machine.

For certain color applications, it has been found that prior art stripper finger systems are unsatisfactory to effect adequate post-fuser nip separation of the recording substrate. That is, during the electrostatographic printing process, the recording substrate is exposed to many stress forces such as high temperature and pressure, as well as intensified energy levels required to achieve multi-toner layer transfer. Moreover multi-color process involve higher toner transfer mass and increased dwell time in the fuser nip relative to comparable black and white copying systems.

The strength of the recording substrate is at its weakest immediately following the fuser nip. It has been found that distortions are created in the recording substrate if the recording substrate is not permitted to exit and cool after passing through the fuser nip in some manner consistent with the strains induced thereon. Thus, handling and processing of the recording substrate immediately following the fuser nip is critical.

One type of distortion that has been observed in multi-color electrostatographic applications is the appearance of waves along a longitudinal path parallel to the leading edge of the recording substrate. Such waves appear as a ripple undulating across the entire length of the paper path. This problem is more prevalent in high relative humidity conditions and becomes more prominent when relatively lighter weight paper is used as the recording substrate. It has been found that applying pressure to the recording substrate as it exits the fuser nip such that the central axis of the recording substrate is forced upward relative to inboard and outboard edges thereof, imparting an arcuate profile therein, eliminates the formation of waves. Accordingly, the primary object of this invention is to provide a post fuser nip apparatus for imparting an arcuate profile into the recording substrate and to further sustain this arcuate profile for a short cooling period after the substrate passes through the nip to eliminate the formation of waves therein during the fusing process.

The following disclosures may be relevant to various aspects of the present invention:

U.S. Pat. No. 4,028,050
Patentee: Bar-on
Issued: Jun. 7,1977

U.S. Pat. No. 4,771,310
Patentee: Leo et al.
Issued: Sep. 13, 1988

U.S. Pat. No. 4,929,983
Patentee: Barton et al.
Issued: May 29, 1990

The relevant portions of the foregoing disclosures may be briefly summarized as follows:

U.S. Pat. No. 4,028,050 discloses an apparatus for stripping copy sheets from a heated fuser member in a xerographic copier. The apparatus comprises a plurality of stripper fingers and a combination support and bias means therefor, wherein the support and bias means includes a unitary member coupled to each stripper finger constituting an integral assembly. Each integral assembly is fixedly supported adjacent the fuser member so that the leading edge of each stripper finger engages with the fuser member to strip the copy sheet therefrom.

U.S. Pat. No. 4,771,310 discloses a stripper finger mechanism for separating recording sheets from the surface of a roll member. A plurality of flexible stripper fingers are arranged such that the finger ends are angled against a fuser roller surface to effect initial separation of a fused copy sheet therefrom. Each stripper finger includes a generally centrally located raised edge for providing a gradually sloping support to lift the fused copy sheet following initial separation from the fuser roll surface.

U.S. Pat. No. 4,929,983 discloses a stripper for separating a print substrate from a fuser member in an electrostatographic printing machine. The stripper includes a substantially flat, resiliently flexible, finger-like member having a raised dimple-like bump adjacent one end thereof for contacting the print substrate once stripped from the fuser member. That patent does not contemplate nor address the problem of waves formed in a recording substrate during multi-color electrostatographic printing.

In accordance with one aspect of the present invention, an apparatus for preventing the formation of waves in a sheet substrate is provided, wherein an assembly including a pair of roll members forming a nip for transporting the sheet substrate along a path of movement therethrough is further provided with an element for imparting an arcuate-shaped profile in the sheet substrate along a generally central axis substantially perpendicular to the path of movement of the sheet substrate subsequent to the transport thereof through the nip.

In accordance with another aspect of the invention, a fusing apparatus for affixing a toner image onto a recording substrate is provided, wherein a pair of roll members, including at least one heated roll member, forms a nip therebetween for transporting the substrate along a path of movement therethrough. The fusing apparatus further includes an element for preventing the formation of waves in a sheet substrate comprising a member for imparting an arcuate-shaped profile in the substrate along a generally central axis substantially perpendicular to the path of movement of the substrate subsequent to the transport thereof through the nip.

In yet another aspect of the invention, an electrostatographic printing apparatus including a fuser apparatus having a heated fuser roll and a backup pressure roll forming a fuser nip therebetween is provided with a baffle assembly supported transversely adjacent the fuser nip for receiving the sheet substrate subsequent to the transport thereof through the fuser nip. The fuser apparatus further includes means, mounted to the baffle assembly, for imparting an arcuate-shaped profile in the sheet substrate along a generally central axis substantially perpendicular to the path of movement thereof.

These and other aspects of the present invention will become apparent from the following description in conjunction with the accompanying drawings in which.

Figure 1:
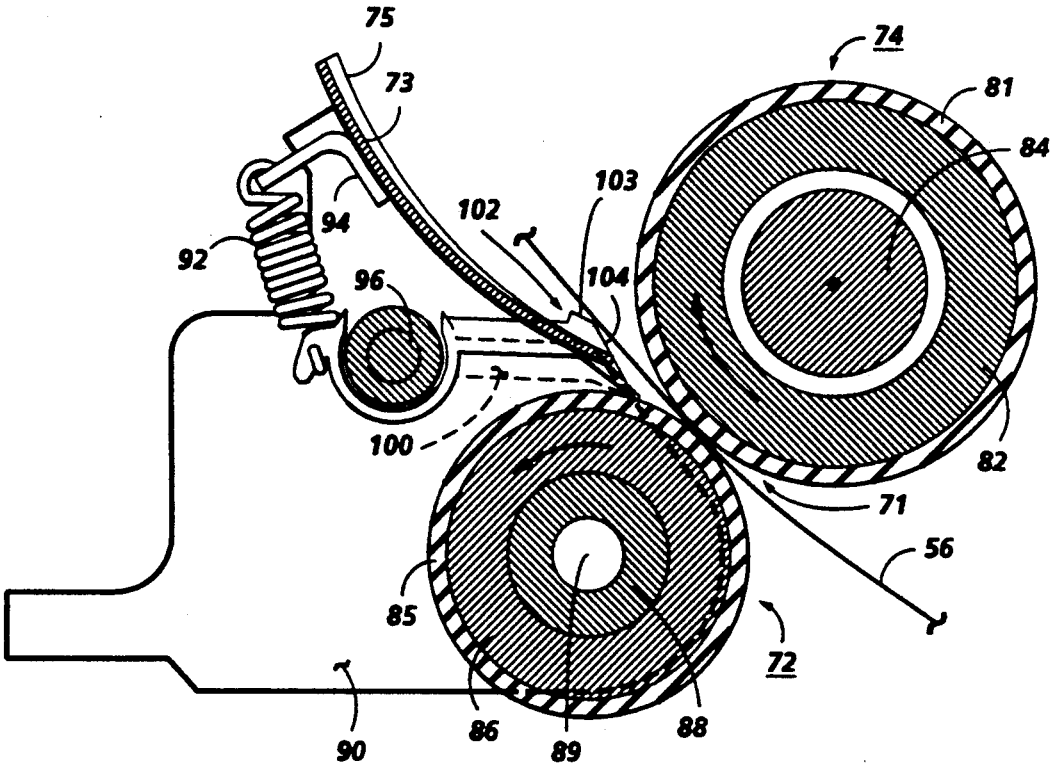
FIG. 1 is a cross-sectional side view of the wave restricting apparatus of the present invention showing the fuser assembly having an element for imparting an arcuate-shaped profile in a sheet substrate.

For a general understanding of the features of the present invention, reference is made to the drawings wherein like reference numerals have been used throughout to designate identical elements. While the present invention will be described in connection with a preferred embodiment thereof, it will understood that it is not intended that the invention be limited to this preferred embodiment. On the contrary, the present invention is intended to cover all alternatives, modifications, and equivalents as may be included within the spirit and scope of the invention as defined by the appended claims.

Figure 4:
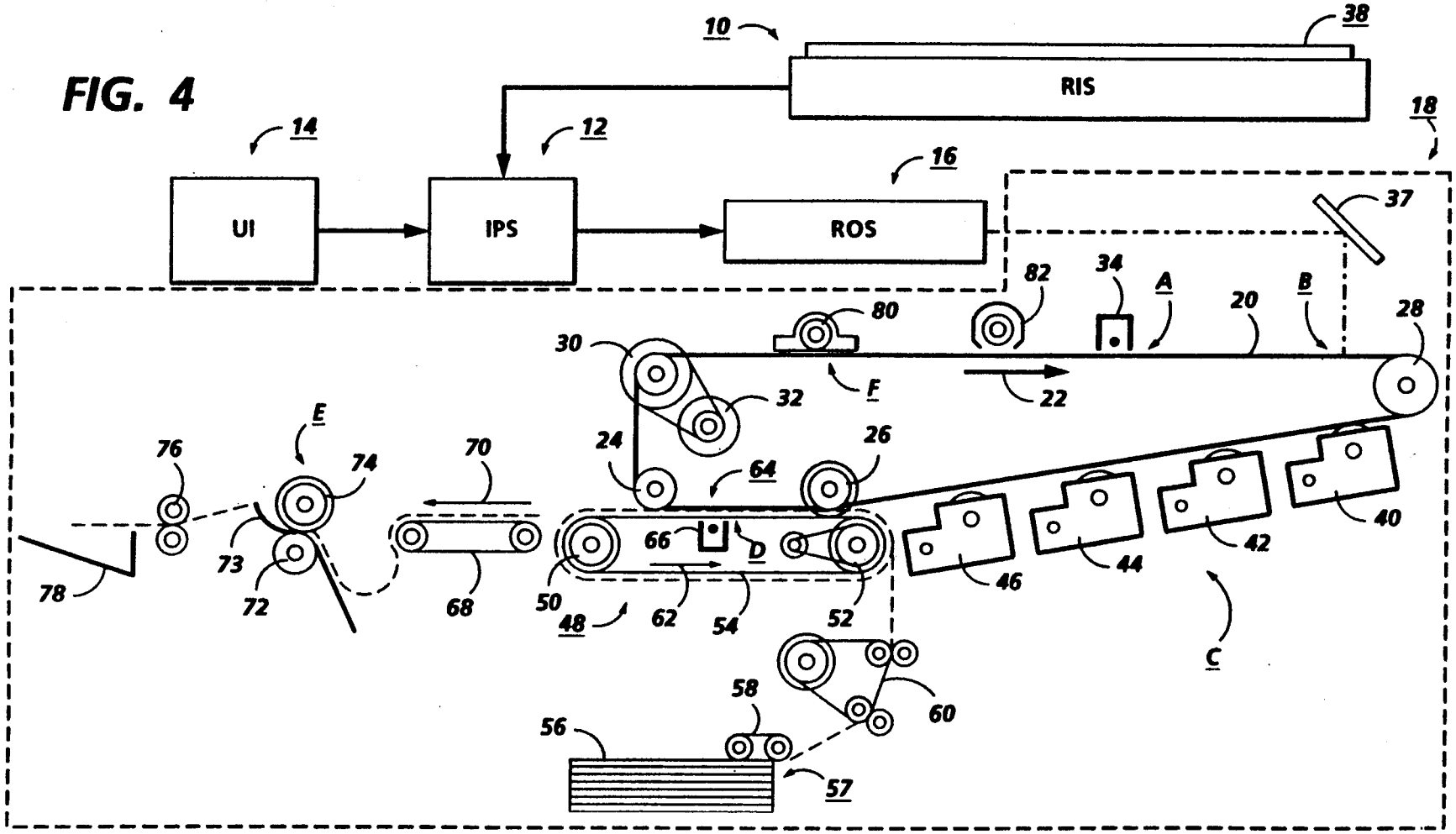
FIG. 4 is a schematic elevational view showing a multi-color electrophotographic printing machine incorporating the features of the present invention.

Referring initially to FIG. 4 before describing the specific features of the present invention, a schematic depiction of the various components of an exemplary multi-color electrophotographic reproducing apparatus incorporating the fuser apparatus of the present invention is provided. Although the apparatus of the present invention is particularly well adapted for use in an automatic multi-color electrophotographic reproducing machine, it will become apparent from the following discussion that the present fuser apparatus is equally well-suited for use in a wide variety of electrostatographic processing machines as well as various other systems requiring transport of a sheet substrate through a nip. Thus, it will be appreciated that the invention described in detail herein is not necessarily limited in its application to the particular embodiment or embodiments shown.

Inasmuch as the art of electrophotographic printing is well known, the various processing stations employed in FIG. 4 will be shown schematically and their operation described briefly with reference thereto. The exemplary electrophotographic reproducing apparatus illustrated in FIG. 4 shows a multi-color electroreprographic printing machine wherein a multi-color original document 38 is positioned on a raster input scanner (RIS), indicated generally be reference numeral 10. The RIS 10 contains document illumination lamps, optics, a mechanical scanning drive, and at least one charge coupled device or CCD array coupled together in a system for capturing the entire multi-color image of the original document 38 and for converting the image to a series of raster scan lines having a set of primary color density information, i.e. red, green and blue densities, for each point in the original document.

The information developed by RIS 10 is transmitted to an image processing system (IPS), indicated generally by the reference numeral 12. IPS 12 converts the set of density information to a set of colorimetric coordinate signals and manages the image data flow to a raster output scanner (ROS), indicated generally by the reference numeral 16. A user interface (UI), indicated generally by the reference numeral 14, is coupled to IPS 12 for communication therewith, enabling an operator to control various operator adjustable functions. UI 14 may be a touch screen, or any other suitable control panel which provides a machine operator with the capability to adjust selective parameters of the copy or print.

ROS 16 includes a laser with rotating polygon mirror blocks. Preferably, a nine facet polygon is used to produce a flowing light image of the original document in a non-distorted manner. The ROS 16 illuminates, via mirror 37, the charged portion of a photoconductive belt 20 of a printer or marking engine, indicated generally by the reference numeral 18, at a rate of about 400 pixels per inch.

The photoconductive belt 20 is preferably fabricated from a photoconductive material coated on a grounding layer, which, in turn, is coated on an anti-curl backing layer. The photoconductive material is made from a transport layer coated on a generator layer. The transport layer transports positive charges from the generator layer which is coated on a very thin grounding layer which allows light to pass therethrough. The transport layer contains molecules of di-m-tolydiphenylbiphenyldiamine dispersed in a polycarbonate while the generation layer is made from trigonal selenium and the grounding layer is made from a titanium coated Mylar. The grounding layer is very thin and allows light to pass therethrough. It will be appreciated by one of skill in the art that various other suitable photoconductive materials, grounding layers, and anti-curl backing layers may also be employed.

With continued reference to FIG. 4, the printer or marking engine 18 of the present multi-color electronic reprographic printing system is an electrophotographic printing machine. In the exemplary marking engine, photoconductive belt 20, moves in the direction of arrow 22 to advance the photoconductive surface thereof through various successive processing stations disposed about the path of movement thereof. Photoconductive belt 20 is entrained about rotatably mounted transfer rollers 24 and 26, tension roller 28, and drive roller 30. Drive roller 30 is rotated by a motor 32 coupled thereto by any suitable means such as a belt drive, so as to advance belt 20.

Initially, a portion of photoconductive belt 20 passes through a charging station, indicated generally by the reference letter A. At charging station A, a corona generating device 34 charges photoconductive belt 20 to a relatively high, substantially uniform potential. A plurality of corona generating devices may also be used for this operation.

Once charged, the photoconductive belt 20 is advanced to an exposure station, indicated generally by reference letter B, where a modulated light beam corresponding to information derived by RIS 10 is transmitted onto the photoconductive surface. The modulated light beam illuminates selective portions of the photoconductive surface to form an electrostatic latent image of the original multi-color document on the photoconductive surface of belt 20. The photoconductive belt 20 is exposed at least three times to record at least three latent images thereon corresponding to the complementary primary colors in the original multi-color document.

After the electrostatic latent images have been recorded on photoconductive belt 20, the belt 20 advances to a development station, indicated generally by C. Development station C comprises a magnetic brush development system including four individual developer units indicated by reference numerals 40, 42, 44 and 46. The developer units are of a type generally referred to in the art as "magnetic brush development units" used for depositing developing material onto the electrostatic latent image.

A typical magnetic brush development system employs a magnetizable developer material including magnetic carrier granules having toner particles adhering triboelectrically thereto. The developer material is continually brought through a directional flux field to form a brush of developer material. In each developer unit, developer material is constantly mixed so as to continually provide a magnetic roll brush with fresh developer material such that the magnetic roll brush having developer material thereon is brought into contact with the photoconductive surface of photoconductive belt 20. In order to achieve multi-color development, developer units 40, 42, and 44, respectively, apply toner particles of a specific color corresponding to the compliment of the specific color separated electrostatic latent image recorded on the photoconductive surface. The color of the toner particles in each developer unit is adapted to absorb light within a predetermined spectral region of the electromagnetic wave spectrum. For example, an electrostatic latent image formed by discharging the portions of charge on the photoconductive belt 20 corresponding to the green regions of the original document 38 will record the red and blue portions as areas of relatively high charge density on photoconductive belt 20, while the green areas will be reduced to a voltage level ineffective for development. A visible image is then developed on the charged areas by having developer unit 40 apply green absorbing (magenta) toner particles onto the electrostatic latent image recorded on photoconductive belt 20. Similarly, a blue separation is developed by developer unit 42 with blue absorbing (yellow) toner particles, and the red separation is developed by developer unit 44 with red absorbing (cyan) toner particles. Developer unit 46 contains black toner particles and may be used to develop the black electrostatic latent image areas formed from a color or black and white original document.

Each of the developer units is moved into and out of an operative position to develop the latent image on belt 20. In the operative position, the magnetic brush is positioned substantially adjacent the photoconductive belt, while in the non-operative position, the magnetic brush is spaced therefrom. In FIG. 4, developer unit 40 is shown in the operative position with developer units 42, 44 and 46 being in the non-operative position. During development of each electrostatic latent image, only one developer unit is in the operative position, while the remaining developer units are maintained in the non-operative position. This insures that each electrostatic latent image is developed with toner particles of the appropriate color without the commingling of developer materials of different colors.

After development, the toner image on photoconductive belt 20 is moved to a transfer station, indicated generally by the reference letter D. The transfer station D includes a transfer zone, generally indicated by reference numeral 64, where the toner image is transferred from the photoconductive belt 20 to a recording substrate, such as plain paper or other various sheet support materials. The transfer station D further includes a transport apparatus, indicated generally by the reference numeral 48, for transporting the recording substrate into contact with photoconductive belt 20.

Transport apparatus 48 includes a pair of spaced belts 54 entrained about a pair of substantially cylindrical rollers 50 and 52. A gripping apparatus (not shown) extends between belts 54 and moves in unison therewith to advance a sheet of recording substrate 56 delivered to the gripping apparatus from a stack of sheets disposed on a tray 57. A friction feed roll 58 advances the uppermost sheet from the stack in tray 57 onto a pre-transfer transport 60, which, in turn, advances the sheet of recording substrate 56 to sheet transport 48 in synchronism with the movement of the gripping apparatus. In this way, the recording substrate 56 arrives at a preselected position, namely a loading zone, to be received by the open gripping apparatus which secures the sheet of recording substrate thereto for transport through a recirculating path. The sheet 56 is thereby placed into contact with the photoconductive belt 20, as belts 54 move in the direction of arrow 62 in synchronism with the developed toner image on the photoconductive belt 20. Thus, the gripping apparatus described hereinabove enables each of the appropriately developed electrostatic latent images recorded on the photoconductive surface to be transferred to the recording substrate in superimposed registration with one another, forming a multi-color copy of the colored original document.

At transfer zone 64, a corona generating device 66 sprays ions onto the backside of the recording substrate to induce a charge thereon at a proper magnitude and polarity for attracting the toner image from photoconductive belt 20. The recording substrate remains secured to the gripping apparatus moving in a recirculating path for three cycles such that each different color toner image is transferred to the recording substrate in superimposed registration with one another. One skilled in the art will appreciate that the sheet may move in a recirculating path for four or more cycles if desirable such as when under color black removal is used.

After the last transfer operation, the sheet transport system 48 directs the recording substrate to a vacuum conveyor 68 for transporting the recording substrate in the direction of arrow 70 to a fusing station, indicated generally by the reference letter E. The fusing station includes a heated fuser roll 74 and a backup pressure roll 72 forming a fuser nip 71 therebetween. The sheet of recording substrate 56 passes through the fuser nip 71 so that the toner image on the recording substrate 56 contacts fuser roll 74 to be affixed to the recording substrate 56. Thereafter, the recording substrate 56 is advanced through a baffle assembly 73 to a pair of rolls 76 for transporting the final output document to a catch tray 78 to be removed by a machine operator.

The last processing station in the direction of movement of belt 20 is a cleaning station, indicated generally by the reference letter F. A rotatably mounted fibrous brush 80 is positioned in the cleaning station A and maintained in contact with photoconductive belt 20 to remove residual toner particles remaining after the transfer operation. Thereafter, lamp 82 illuminates photoconductive belt 20 to remove any residual charge remaining thereon prior to the start of the next successive print or copy cycle.

In summary, the ROS 16 exposes the photoconductive belt 20 to record a set of subtractive primary latent images thereon, corresponding to the signals transmitted from IPS 12. One latent image is developed with cyan developer material, another is developed with magenta developer material, and the third latent image is developed with yellow developer material. These developed images are transferred to a recording substrate such as paper or vellum in superimposed registration with one another to form a multi-colored image thereon. This multi-colored image is then fused to the recording substrate to form a color output document. The foregoing description should be sufficient for the purposes of the present application for patent to illustrate the general application of a multi-color electrophotographic printing apparatus incorporating the features of the present invention. As described, an electrophotographic printing apparatus may take the form of any of several well known devices or systems. Variations of specific electrostatographic processing subsystems or processes may be expected without effecting the operation of the present invention.

Figure 2:
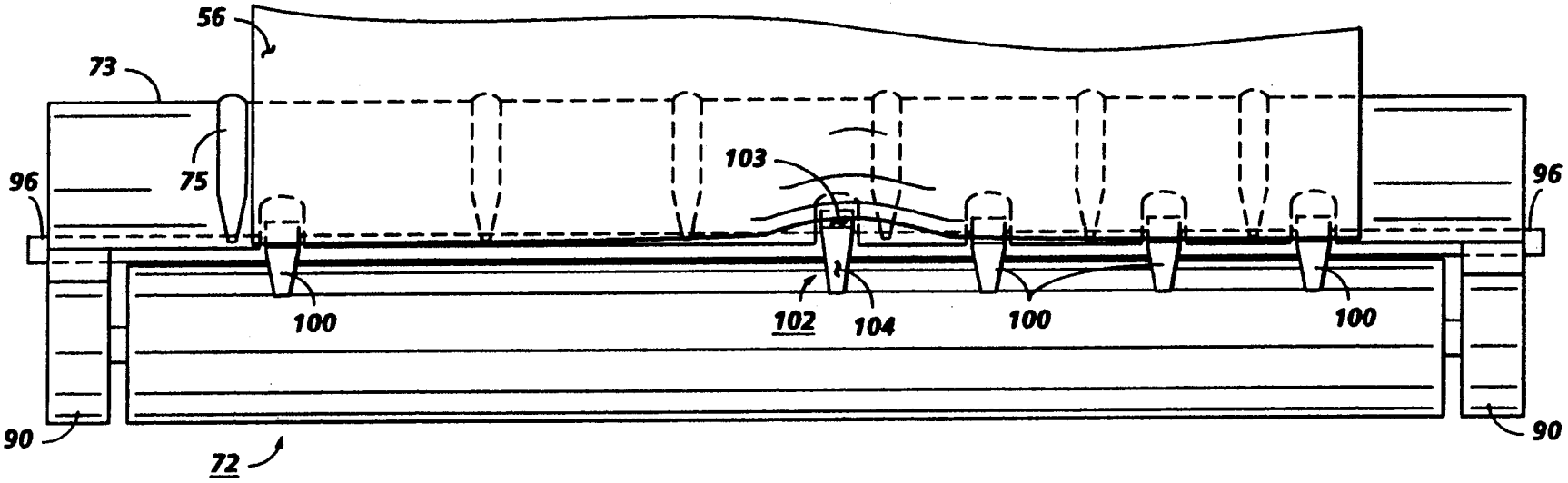
FIG. 2 is a front view of the fuser assembly shown in FIG. 1 illustrating the arcuate-shaped profile imparted on the recording substrate as provided by the present invention.
Figure 3:
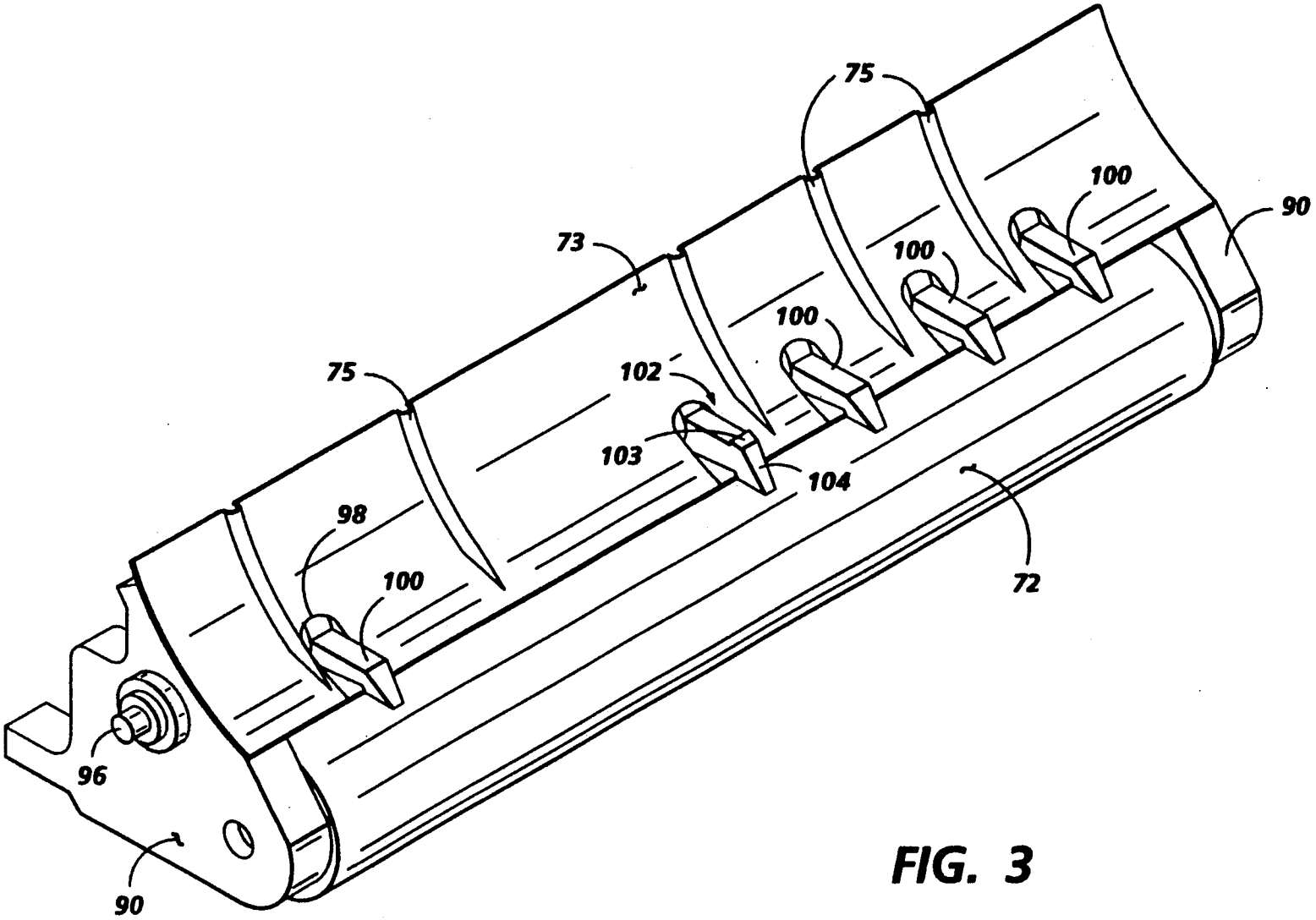
FIG. 3 is a perspective view of the fuser assembly shown in FIG. 1.

Moving now to FIGS. 1-3, the particular features of the fuser apparatus including the improved baffle assembly of the present invention will be described in greater detail. As shown in FIG. 1, the fuser assembly comprises a heated fuser roll 74 and a backup pressure roll 72 which cooperate to form a fuser nip 71 therebetween through which a sheet of recording substrate 56 having toner images thereon passes.

The fuser roll 74 comprises a core 82 having a thin layer 81 of an elastomer coated thereon. The core 82 may be made of various metals such as iron, aluminum, nickel, stainless steel, etc., as well as various synthetic resins. The core 82 is a hollow cylinder having a heating element 84 disposed therein, generally along the axis thereof to supply thermal energy for the fusing operation. Heating elements suitable for this purpose are known in the art and may comprise a quartz heater having a quartz envelope and a Tungsten resistance heating element disposed internal thereto. Heating means sufficient for providing heat in the fusing operation of the present invention are well known in the art and will not be described in detail herein.

The backup pressure roll 72 comprises a metal core 86 having a layer 85 of heat resistant material thereon. The backup pressure roll 72 may comprise any suitable construction, for example, a steel cylinder, but preferably comprises a rigid steel core or shaft having a Viton elastomer surface or layer disposed thereover and affixed thereto. The backup pressure roll 72 further includes a shaft end 89 located at either end thereof, for being received by a mounting bearing 88 to rotatably support the backup pressure roll 72. A suitable backup pressure roll 72 has an overall diameter of approximately 1.55 inches including a 0.1 inch cover layer of Viton elastomer or other suitable high temperature elastomeric material, for example, fluorosilicone or silicone rubber. The specific dimensions of the backup pressure roll 72 will be dictated by the requirements of the particular system in which the fuser apparatus is employed. Since it is contemplated that the electrostatographic printing machine in which the present fuser apparatus is utilized will have the capability of accepting and processing recording substrates of varying lengths, the length of either roll 72, 74 is approximately 15.5 inches, for accommodating various sizes of recording substrates. The dimensions of the recording substrate, of course, will be dictated by the size of the original input information recorded on the photoconductive surface.

A pair of mounting brackets 90 located at either end of the backup pressure roll 72 are provided for supporting the backup pressure roll 72 and baffle member 73 in the electrostatographic printing machine. Each mounting bracket 90 further provides a support surface for baffle member 73 comprising an arcuate plate positioned substantially adjacent to the fuser nip 71. Baffle member 73 supports the recording substrate 56 as it passes through the nip 71 and directs the recording substrate 56 on a path toward the conveyor assembly 76 which transports the recording substrate 56 out of the machine. To this end, the baffle member 73 includes a plurality of protruding rib elements 75 protruding from the surface thereof and interspaced along the length thereof.

The baffle assembly of the present invention further includes a wedge-like member 102 positioned generally along the center of the fuser nip 71 having a sloped contact surface 104 for contacting the lead edge of the recording substrate after it travels out of the fuser nip 71 and a raised support surface 103 for exerting upward pressure against the sheet of recording substrate 56. In a preferred embodiment, the baffle member 73 includes at least one slot 98 for receiving the wedge-like member 102. The wedge-like member 102 includes a semi-circular segment for mounting onto a support bar 96 secured between mounting brackets 90 behind baffle member 73. This configuration provides a cantilevered mounting assembly for supporting the wedge-like member 102 and engaging the wedge-like member 102 into contact with the surface of the backup pressure roll 72.

In the exemplary embodiment shown in FIG. 1, the wedge-like member 102 is further urged against the backup pressure roller 72 via a spring member 92 coupled between a right angle bracket 94 fastened against the backside of baffle member 73 and a hook member disposed along the back portion of the semi-circular segment of the wedge-like member 102. The wedge-like member 102 is maintained laterally relative to backup pressure roller 72 by slot 98 formed in baffle member 73. Slot 98 is oversized relative to the dimension of the wedge-like member 102 to allow some play or movement thereof as the wedge-like member rides on the rotating pressure backup roll 72.

The wedge-like member 102 provides a raised surface along the central portion of the baffle member 73, so as to exert an upward force on the recording substrate 56 after it travels through the fuser nip 71. This upward force imparts an arcuate profile in the recording substrate 56, along a generally central axis substantially perpendicular to the path of movement thereof. It has been found that imparting such an arcuate-shaped profile in the recording substrate 56 provides sufficient lateral support thereto for preventing the formation of waves in the recording substrate 56, as created by the other stresses acting on the recording substrate 56, as discussed previously herein. It has further been found that optimum wave elimination results when the wedge-like member has a height dimension between approximately 3.9 mm to 4.4 mm to raise the recording substrate by that amount with respect to the path of movement of the sheet substrate through the fuser nip 71. It will be recognized by those of skill in the art that the wedge-like member 102 serves as a wave restrictor and can take on any configuration or form for imparting an arcuate profile in the recording substrate as it passes from the fuser nip 71 to the baffle assembly 73.

The baffle assembly 73 of the present invention further includes a plurality of stripper fingers 100 interspaced along the length of baffle member 73 adjacent fuser nip 71. Like the wedge-like member 102, each stripper finger 100 rides in contact with the backup pressure roll 72, contacting the lead edge of the recording substrate 56 as it travels out of fuser nip 71. Likewise, in similar manner to wedge-like member 102, each stripper finger 100 is mounted through a slot 98 in baffle member 73 so that the leading edge of each stripper finger 100 is in engagement with the backup pressure roll 72 and biased thereagainst by means of a spring element 92 coupled between support bar 96 and each stripper finger 100, providing a cantilevered mounting configuration therefor. The above-described stripper fingers provide an effective mechanism for stripping substrates ranging from light weight paper to heavy weight specialty substrates including film substrates such as polyethylene transparencies and vellums. Any alternate form of stripper finger and/or mounting configuration for separating the recording substrate from either roll making up the fuser nip 71 can be used, as is well known in the art.

In recapitulation, it should now be clear from the foregoing discussion that the apparatus of the present invention provides a novel baffle assembly for eliminating the formation of waves in a recording substrate produced by multi-color electrophotographic printing systems. The present invention provides a wedge-like member for imparting an arcuate-shaped profile on the recording substrate along an axis perpendicular to the path of movement thereof as the recording substrate passes beyond the fuser nip. It is believed that the position, dimension, and configuration of the wedge-like member provides sufficient pressure for imparting a substantially arcuate-shaped profile into the recording substrate for eliminating wave formation in the recording substrate inherent to prior art multi-color xerographic processes.

It is, therefore, apparent that there has been provided, in accordance with the present invention, a novel fuser assembly that fully satisfies the aims and advantages set forth hereinabove. While the present invention has been described in conjunction with a specific embodiment thereof, it will be evident to those skilled in the art that may alternatives modifications and variations are possible to achieve the desired results. Accordingly, the present invention is intended to embrace all such alternatives, modifications, and variations which may fall within the spirit and scope of the following claims.

We claim:

1. An apparatus for preventing formation of waves in a sheet substrate having been transported through a nip formed by a pair of roll members, comprising:

a plurality of stripper fingers selectively positioned along a length of the nip and adjacent thereto for effecting initial separation of the sheet substrate from one of the pair of roll members subsequent to transport of the sheet substrate through the nip; and means for imparting an arcuate-shaped profile in the sheet substrate, said imparting means including:

a lever arm adapted to be biased against one of the pair of roll members forming the nip so as to allow relative movement therebetween; and an elevated support surface relative to said plurality of stripper fingers for exerting a force against the sheet substrate subsequent to the transport thereof through the nip to prevent the formation of waves in the sheet substrate.

2. The apparatus of claim 1, wherein said imparting means further includes a wedge-like segment positioned substantially adjacent to a central portion of the nip.

3. The apparatus of claim 1, wherein said elevated support surface provides a horizontal offset between approximately 3.9 mm to 4.4 mm with respect to the nip.

4. The apparatus of claim 2, wherein said wedge-like segment further includes a contact surface for directing the sheet substrate toward said elevated support surface as the sheet substrate is transported through the nip.

5. The apparatus of claim 1, wherein each of said plurality of stripper fingers is adapted to be biased against one of the roll members making up the pair of roll members forming the nip.

6. The apparatus of claim 1, further including a baffle assembly fixedly supported transversely adjacent the nip for receiving the sheet substrate subsequent to the transport thereof through the nip.

7. A fusing apparatus for affixing a toner image onto a recording substrate and adapted to prevent formation of waves in the recording substrate having been transported therethrough, comprising:

a pair of roll members forming a nip therebetween for transporting the recording substrate along a path of movement therethrough;

a plurality of stripper fingers selectively positioned along a length of the nip and adjacent thereto for effecting initial separation of the recording substrate from one of the pair of roll members subsequent to transport of the sheet substrate through the nip; and means for imparting an arcuate-shaped profile in the sheet substrate, said imparting means including:

a lever arm adapted to be biased against one of the pair of roll members forming the nip so as to allow relative movement therebetween; and an elevated support surface relative to said plurality of stripper fingers for exerting a force against the sheet substrate subsequent to the transport thereof through the nip to prevent the formation of waves in the sheet substrate.

8. The apparatus of claim 7, wherein said imparting means further includes a wedge-like segment positioned substantially adjacent to a central portion of the nip.

9. The apparatus of claim 7, wherein said elevated support surface provides a horizontal offset between approximately 3.9 mm to 4.4 mm with respect to the path of movement of the substrate subsequent to the transport thereof through the nip.

10. The apparatus of claim 8, wherein said wedge-like segment further includes a contact surface for directing the substrate toward said elevated support surface as the recording substrate is transported through the nip.

11. The apparatus of claim 7, wherein each of said plurality of stripper fingers is adapted to be biased against one of the roll members making up the pair of roll members forming the nip.

12. The apparatus of claim 7, further including a baffle assembly fixedly supported transversely adjacent the nip for receiving the substrate subsequent to the transport thereof through the nip.

13. An electrostatographic printing apparatus including a fuser apparatus having a heated fuser roll and a backup pressure roll forming a fuser nip therebetween, the fuser roll and the backup pressure roll being cooperative to provide means for transporting a sheet substrate along a path of movement therebetween, the fuser apparatus being adapted to prevent formation of waves in the sheet substrate having been transported therethrough, comprising:

a baffle assembly fixedly supported transversely adjacent the fuser nip for receiving the sheet substrate subsequent to transport thereof through the fuser nip;

a plurality of stripper fingers selectively positioned adjacent to and along a length of the fuser nip for effecting initial separation of the sheet substrate from the fuser nip subsequent to transport of the sheet substrate therethrough; and means for imparting an arcuate-shaped profile in the sheet substrate, said imparting means including:

a lever arm adapted to be biased against one of the pair of roll members forming the nip so as to allow relative movement therebetween; and an elevated support surface relative to said plurality of stripper fingers for exerting a force against the sheet substrate subsequent to the transport thereof through the nip to prevent the formation of waves in the sheet substrate.

14. The apparatus of claim 13, wherein said imparting means further includes a wedge-like segment positioned substantially adjacent to a central portion of the fuser nip.

15. The apparatus of claim 13, wherein said elevated support surface provides a horizontal offset between approximately 3.9 mm to 4.4 mm with respect to the path of movement of the sheet substrate subsequent to the transport thereof through the nip.

16. The apparatus of claim 14, wherein said wedge-like segment further includes a contact surface for directing the sheet substrate toward said elevated support surface as the sheet substrate is transported through the nip.

17. The apparatus of claim 13, wherein each of said plurality of stripper fingers is adapted to be biased against one of the roll members making up the pair of roll members forming the nip.

* * * * *